US005806691A

United States Patent [19]

Nelson

[11] Patent Number: 5,806,691

[45] Date of Patent: Sep. 15, 1998

[54] SURFACE MOUNTABLE SKI STORAGE ASSEMBLY

[76] Inventor: Craig W. Nelson, 160 Indian Trail, Scituate, Mass. 02066

[21] Appl. No.: 681,399

[22] Filed: Jul. 23, 1996

[51] Int. Cl.[6] ..... A47F 7/00

[52] U.S. Cl. ..... 211/70.5; 70/58; 211/4; D6/552

[58] Field of Search ..... 211/70.5, 87, 94, 211/4; 70/58; 248/500, 505; D6/552

[56] References Cited

U.S. PATENT DOCUMENTS

| | | | |
|---|---|---|---|
| 2,581,824 | 1/1952 | Windahl | 211/70.5 X |
| 3,164,256 | 1/1965 | Bennett | 211/70.5 |
| 3,330,573 | 7/1967 | Sieloff | 211/70.5 X |
| 4,461,385 | 7/1984 | Clouser | 70/58 X |
| 4,508,229 | 4/1985 | Yost | 211/70.5 |
| 5,022,536 | 6/1991 | Peirson | 211/4 X |
| 5,477,968 | 12/1995 | Largent et al. | 211/70.5 X |

*Primary Examiner*—Robert W. Gibson, Jr.
*Attorney, Agent, or Firm*—John M. Brandt

[57] ABSTRACT

A ski storage assembly mountable on a planar surface such as a wall, door, or ceiling consisting of a longitudinal bottom support having a lip for containing the heel of the ski and an upper rotatable bar for retaining the tip of the ski. An optional force bar, mountable midway between the bottom support and rotatable bar and an optional retaining wire are also disclosed.

2 Claims, 1 Drawing Sheet

SURFACE MOUNTABLE SKI STORAGE ASSEMBLY

FIELD OF THE INVENTION

The invention relates to devices for securing implements in storage and more particularly relates to an assembly mountable on a planar surface for holding skis in a variety of positions.

DESCRIPTION OF THE PRIOR ART

A great variety of ski holding devices and assemblies exist in the prior art. In particular, U.S. Pat. No. 4,635,800, Stempin, discloses a flexible molded sheet like arrangement, U.S. Pat. No. 4,673,088, Mancini; U.S. Pat. No. 5,285,906, Wisnowski et. al; and U.S. Pat. No. 5,307,944, Reedy all describe integral racks of some size; and U.S. Pat. No. 4,793,496, Wait discloses a wall mounted base plate, again of some size.

In contrast to the prior art the invention disclosed herein presents a surface mountable assembly which can be affixed to any convenient existing wall or other planer structure.

The assembly has the particular advantages of being expandable to retain any number of skis, easily transportable since it uses existing structures as the primary support medium, and a positioning of the elements such that by use of existing ski breaks now commonly mounted on most skis, or an optional force bar, ski camber is effectively and properly maintained.

SUMMARY OF THE INVENTION

The invention may be summarized as an assembly for providing household storage for ski and ski like devices such as snow boards which consist of relatively long narrow planks of various compositions, for example, wood or synthetics, and most often are shaped with a rise in the middle, known as the camber, between the bottom or heel and the upper tip. The assembly consists of a surface mountable longitudinal bottom support having a lip or groove for retaining heel and a surface mountable rotatable bar for securing the tip of the ski. The surface may be any convenient planar household structure such as a wall, door, ceiling, closet interior or any vertical or horizontal rafter of sufficient width.

Most modern skis are equipped with devices known as ski breaks which drop below the lower edge of the ski when the ski is released from the boot. The purpose of these is to dig into the snow to prevent the ski from careening down the slope on which the ski is being used. These breaks will also function to create tension to hold the ski away from the planar surface on which the storage assembly is mounted, the location of the break being usually behind the binding. As the maximum height of the ski camber is under the binding forward of the break position, an optional force bar may be mounted midway between the bottom support and rotatable bar to assist in maintaining the proper camber. This may be used either for skis that have the break retained in an upright position or skis without the break at all.

As the assembly may be mounted such that skis can be stored in any position on a variety of mounting surfaces including a door which is free to move, an additional retaining wire to force the ski against the bottom may optionally be included in the assembly. The wire is attached at both ends to the planar surface in a position below the location of the binding and is arranged to pass over the binding. This feature prevents the skis from falling forward, that is moving toward the tip, when stored in a horizontal position or from moving from side to side when stored on a frequently moved surface such a closet door.

The assembly described herein provides therefore a new and novel way to expeditiously store skis in a variety of positions and household locations with a minimum of mechanical parts. As the skis are fixed at the heel and tip against a planar surface, the camber is retained over a long period of storage by the outward bias of either a ski mounted ski break, or an optional force bar. An optional retaining wire may be used to further secure the skis in particular positions or when the mounting surface is subject to possible disruption.

These and other features and advantages of the invention will be more fully understood from the drawings and description of the preferred embodiment which follows.

DESCRITION OF THE PREFERRED EMBODIMENT

Figure 1:
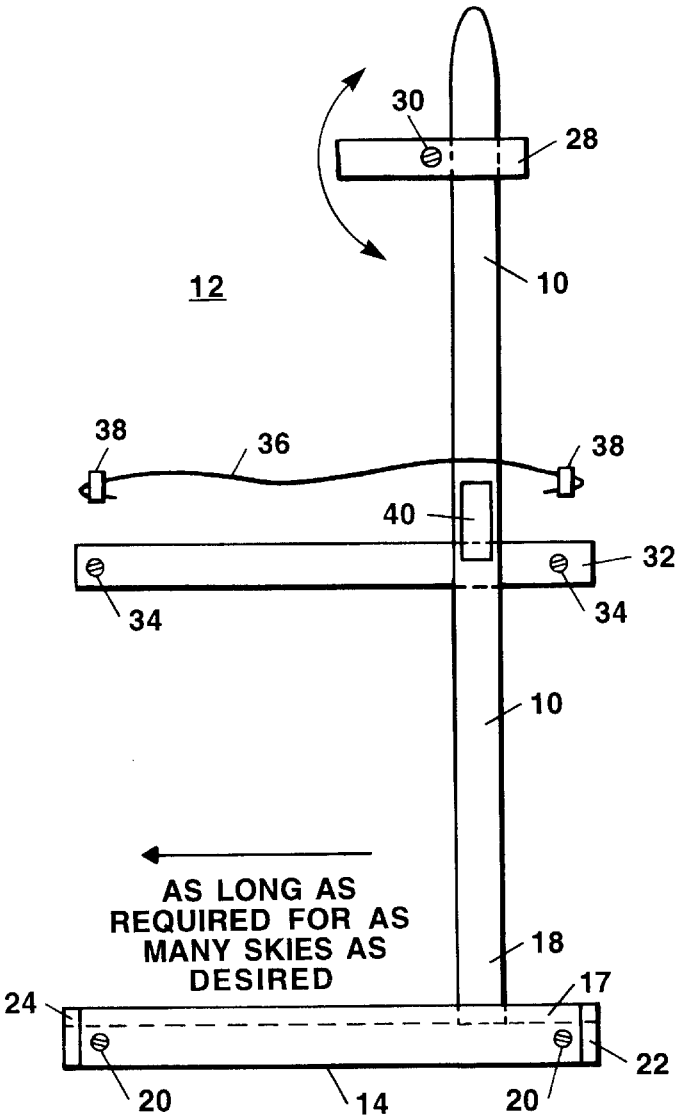
FIG. 1 is a front view of the preferred embodiment of the invention.
Figure 2:
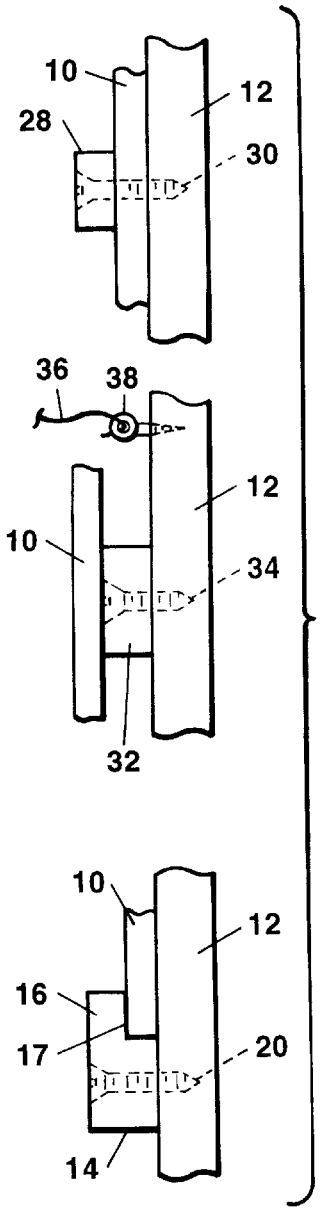
FIG. 2 is a side view of the embodiment of FIG. 1.

Referring to FIGS. 1 and 2, there is illustrated a front view of the preferred embodiment of the invention. Ski 10 is secured to wall 12 by the assembly of the invention consisting of bottom support 14 having lip 16 to form a receiving slot 17 for retaining ski heel 18. Support 14 is mounted on wall 12 by for example screws 20.

The support may be any convenient length to hold as many skis as desired and may have end blocks 22 and 24 to prevent the most peripheral skis from sliding sideways and off the support if inadvertently jarred.

Tip 26 of ski 10 is secured by rotatable bar 28 mounted to wall 12 by, for example, screw 30. Bar 28 rotates from the vertical to the horizontal as shown to clamp ski 10 against wall 12 and is spaced apart from wall 12 an appropriate distance to achieve that result without scratching the ski or stressing the screw 30.

As previously discussed the assembly of the invention provides camber maintenance by the outward counter forces of a ski break not shown. If the ski break is missing, inoperable or a more exact camber retention is desired a force block 32 may be provided mounted by, for example, screws 34 in an appropriate position between support 14 and rotatable bar 28. In this manner the center of the ski will be biased outward while being secured by the assembly at both the heel and tip.

Finally, to provide a means to bias the skis against the heel if the assembly is mounted in any mounting position, for example, on a ceiling, a retaining wire 36 secured by eye screws 38 to surface 12 may be provided.

Wire 36 is most advantageously located so as to pass in contact with the top of a ski binding 40 shown schematically. The retaining wire has the advantage of preventing the skis from falling forward should they be jarred or if the rotating bar is accidentally repositioned.

The assembly may be constructed of any suitable material, in particular wood or plastic and the mounting means for the bottom support and rotatable bar may depend upon the material of the planer surface as well as the preference of the user. As other modifications will now be obvious to those skilled in the art, the invention is hereby defined by the following claims.

What is claimed is:

1. A ski storage assembly adapted to be mounted on a planar surface for holding a plurality of said skis; said assembly comprising in combination:

a. a longitudinal bottom support having a lip on an upper surface thereof to create a slot for securing the heel of said ski against said planar surface and from horizontal and downward vertical movement;

b. means for mounting said longitudinal bottom support to said planar surface;

c. a rotatable bar adapted to rotate parallel to the plane of said planar surface for securing the tip of said ski from horizontal and vertical movement;

d. means for mounting said bar to said planar surface to provide for the rotation of said rotatable bar; and e. a force bar adapted to be mounted to said planar surface between said longitudinal bottom support and said rotatable bar of a thickness sufficient to slightly bias the central portion of said ski outward to maintain the camber of said ski.

2. The apparatus of claim 1 further adapted to hold skis having boot retaining bindings mounted on the tops thereof midway between said ski heel and said ski tip wherein said apparatus further includes a retaining wire adapted to be mounted to said planar surface at both ends of said wire, said wire arranged to pass over said bindings to bias said ski toward said longitudinal bottom support.

* * * * *